US009028348B2

(12) United States Patent
Lazenby

(10) Patent No.: US 9,028,348 B2
(45) Date of Patent: May 12, 2015

(54) SCENT DELIVERY DEVICES AND METHODS OF USE

(71) Applicant: Timothy E Lazenby, Tulsa, OK (US)

(72) Inventor: Timothy E Lazenby, Tulsa, OK (US)

( * ) Notice: Subject to any disclaimer, the term of this patent is extended or adjusted under 35 U.S.C. 154(b) by 12 days.

(21) Appl. No.: 13/853,012

(22) Filed: Mar. 28, 2013

(65) Prior Publication Data

US 2013/0296084 A1 Nov. 7, 2013

Related U.S. Application Data

(60) Provisional application No. 61/616,602, filed on Mar. 28, 2012.

(51) Int. Cl.
*F42B 6/04* (2006.01)
*F42B 12/36* (2006.01)

(52) U.S. Cl.
CPC ..... *F42B 12/362* (2013.01)

(58) Field of Classification Search
USPC ..... 473/578, 581
See application file for complete search history.

(56) References Cited

U.S. PATENT DOCUMENTS

| | | | | |
|---|---|---|---|---|
| 3,150,875 | A | 9/1964 | Searles | |
| 3,565,435 | A | 2/1971 | Bear | |
| 3,893,866 | A | 7/1975 | Hollingsworth | |
| 4,156,496 | A | 5/1979 | Stinson | |
| 4,245,612 | A | 1/1981 | Finlay | |
| 4,463,953 | A | 8/1984 | Jordan | |
| 4,726,584 | A | 2/1988 | Bishop | |
| 4,881,743 | A | 11/1989 | Florenzo | |
| 5,033,446 | A | 7/1991 | Brandt | |
| 5,035,435 | A | 7/1991 | Burgeson et al. | |
| 5,123,657 | A * | 6/1992 | Colt et al. | 473/577 |
| 5,183,259 | A | 2/1993 | Lyon | |
| 5,269,535 | A | 12/1993 | Gagne | |
| 5,307,584 | A | 5/1994 | Jarvis | |
| 5,746,019 | A | 5/1998 | Fisher | |
| 5,836,842 | A * | 11/1998 | McLearan | 473/581 |
| 5,857,281 | A | 1/1999 | Bergquist | |
| 6,027,036 | A | 2/2000 | Taylor | |
| 6,174,251 | B1 * | 1/2001 | Lemote | 473/581 |
| 6,745,950 | B1 | 6/2004 | Longo | |
| 6,857,579 | B2 | 2/2005 | Harris | |
| 6,880,765 | B2 | 4/2005 | Tuomikoski | |
| 7,040,335 | B1 | 5/2006 | Ransom | |
| 7,093,770 | B1 | 8/2006 | Moran | |
| 7,488,267 | B2 | 2/2009 | Hunt | |
| 7,493,910 | B1 | 2/2009 | Ransom | |
| 7,731,612 | B2 | 6/2010 | Martin | |
| 8,439,777 | B2 * | 5/2013 | Pierce et al. | 473/578 |
| 8,444,512 | B2 * | 5/2013 | Pierce et al. | 473/578 |
| 2003/0098363 | A1 | 5/2003 | Stanley | |
| 2006/0261180 | A1 | 11/2006 | Tabb | |
| 2006/0287144 | A1 * | 12/2006 | Martin | 473/578 |
| 2007/0226914 | A1 | 10/2007 | Satayanna | |
| 2008/0051231 | A1 * | 2/2008 | Everett | 473/578 |
| 2010/0031945 | A1 | 2/2010 | Shaffer | |
| 2010/0113195 | A1 | 5/2010 | Rezmer | |

* cited by examiner

*Primary Examiner* — John Ricci
(74) *Attorney, Agent, or Firm* — John M. Behles

(57) ABSTRACT

Scent delivery devices and methods of use are provided herein. According to some embodiments, the present technology may be directed to a scent delivery device configured to be housed within an arrow, the arrow having at least one opening to allow scent within the arrow to pass outwardly from the arrow, device having a base member at least partially insertable within a body of the arrow, a scent bearing member associated with the base, and a cap releaseably associable with the base, the cap covering the scent bearing member.

14 Claims, 2 Drawing Sheets

SCENT DELIVERY DEVICES AND METHODS OF USE

CROSS REFERENCE TO RELATED APPLICATIONS

This non-provisional application claims the priority benefit of U.S. Provisional Application Ser. No. 61/616,602, filed on Mar. 28, 2012, titled "SCENT DELIVERY DEVICES AND METHODS OF USE," which is hereby incorporated by reference herein in its entirety, including all reference cited therein.

FIELD OF THE TECHNOLOGY

Embodiments of the disclosure relate to scent delivery devices and their methods of use. More specifically, but not by way of limitation, the present technology may include scented devices configured to cooperate with arrows to deliver scents in outdoor environments.

BACKGROUND OF THE DISCLOSURE

Scent delivery technologies are known within the hunting arts. While these technologies have been employed to deliver scents in outdoor environments, these scent delivery technologies often require direct user contact with the scent delivery devices during preparation and/or delivery, resulting in scent being transmitted onto the user and/or their clothing. What is needed is a self-contained scent delivery system that remedies the aforementioned deficiencies. These and other advantages of the present technology will be described in greater detail herein.

SUMMARY OF THE DISCLOSURE

According to some embodiments, the present technology may be directed to a scent delivery device configured to be housed within an arrow, the arrow having at least one opening to allow scent within the arrow to pass outwardly from the arrow. The device may comprise: (a) a base member at least partially insertable within a body of the arrow; (b) a scent bearing member associated with the base; (c) a cap releaseably associable with the base, the cap covering the scent bearing member; and (d) wherein when the arrow is traveling at a sufficient velocity and impacts an object, the cap of the scent delivery device disassociates from the base and uncovers the scent bearing member allowing scent of the scent bearing member to pass outwardly from the arrow through the at least one opening.

In one embodiment, the base comprises a nock. In another embodiment, the cap comprises a bumper disposed on a terminal end of the cap. In one aspect, the at least one opening comprises a plurality of apertures disposed proximate a fletching of the arrow.

In one embodiment, the scent bearing member comprises any of animal estrus, acorn cover, animal urine, and musk.

In some embodiments, the present technology is directed to a scent delivery device configured to be housed within an arrow, the arrow having at least one opening to allow scent within the arrow to pass outwardly from the arrow. The device comprises: (a) a body member at least partially insertable within the arrow; (b) a scent disposed within a cap; (c) the cap being releaseably associable with the base; and (d) wherein when the arrow is traveling at a sufficient velocity and impacts an object, the cap of the device is breached within the cap, allowing the scent to pass through the at least one opening.

In one embodiment, the base comprises a nock and the at least one opening comprises a plurality of apertures disposed proximate a fletching of the arrow.

In other aspects, the present technology may be directed a scent delivery arrow having: (a) a body having a first section and a second section that are releaseably attachable to one another, the first section having at least one opening providing a path for outward communication of fluid from within the body; and (b) a scent delivery device, comprising: (i) a base member at least partially insertable within the body of the arrow; (ii) a scent bearing member associated with the base member; and (iii) a cap covering the scent bearing member, the cap being releaseably associable with the base in such a way that the cap releases from the body when an impact force is applied to the arrow.

In one embodiment, cap is at least partially filled with a scented fluid and the scented fluid comprises any of animal estrus, acorn cover, animal urine, and musk.

In another embodiment, the base member is configured to compressively engage with an open end of the first section and the at least one opening comprises a plurality of apertures disposed proximate a fletching of the arrow.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

In the following description, for purposes of explanation, numerous specific details are set forth in order to provide a thorough understanding of the disclosure. It will be apparent, however, to one skilled in the art, that the disclosure may be practiced without these specific details. In other instances, structures and devices are shown at block diagram form only in order to avoid obscuring the disclosure.

Figures 1A, 1B:
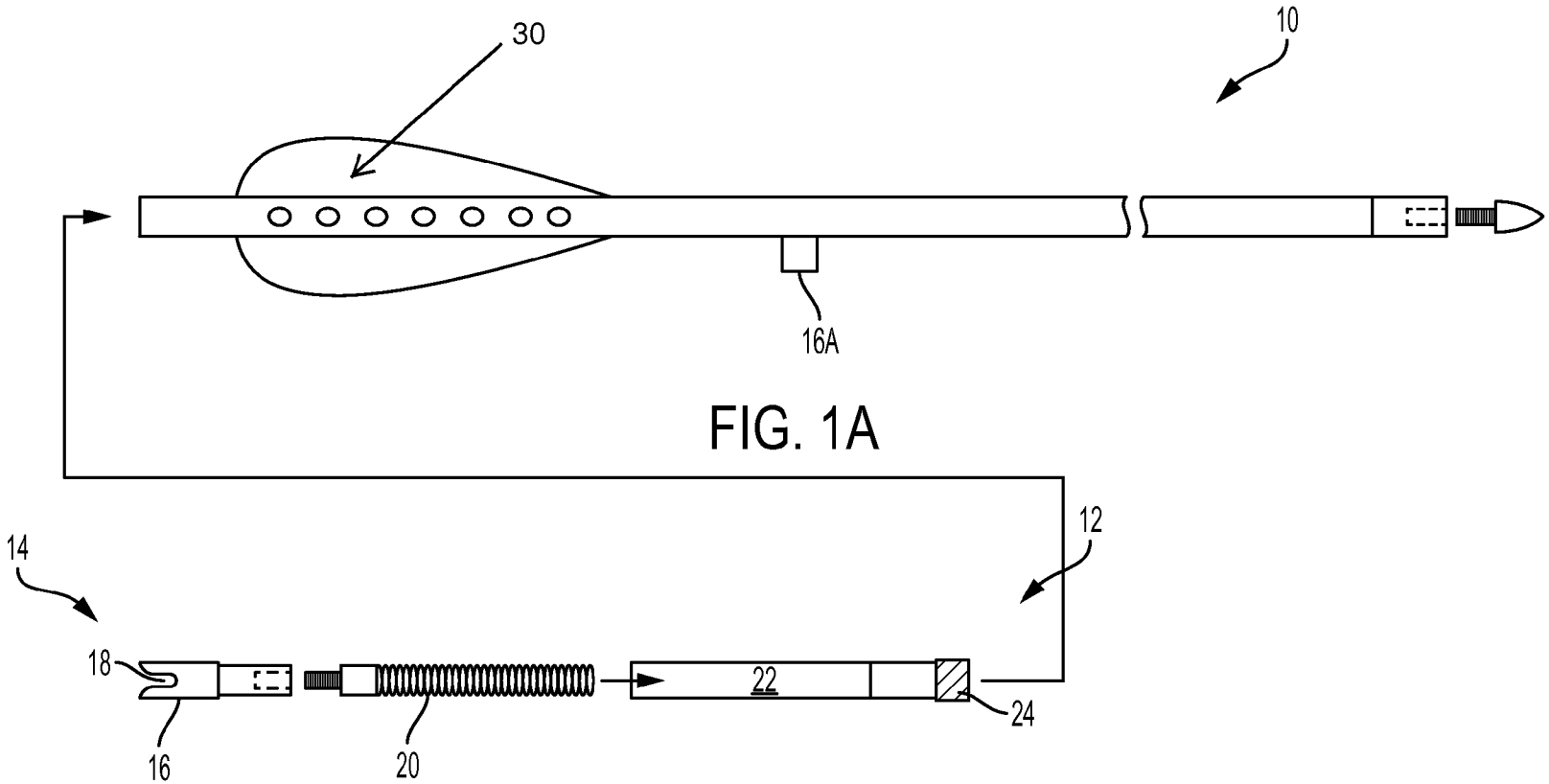
FIG. 1A is an exploded, perspective view of an arrow, for use in accordance with the present technology.
FIG. 1B is an exploded, perspective view of a scent delivery device, for use in accordance with the present technology.

Referring now to the drawings, and in particular, to FIGS. 1A-2B collectively, which illustrate exemplary embodiments of scent delivery devices associated delivery systems, and methods for using the same. FIG. 1A illustrates an exemplary delivery system 10, which in this instance comprises an arrow configured to utilize an exemplary scented device, hereinafter "device 12." Generally speaking, the arrow is shown as comprising an elongated tubular body. The elongated tubular body is designed to receive a tip (e.g., field point) at a first end and a portion of the device 12 on a second end. The second end of the elongated tubular body may include an open end that is configured to receive at least a portion of the device 12, as will be described in greater detail infra.

The body of the arrow may also include a plurality of apertures 30 that provide a path for the communication of scent from within the elongated tubular member, outwardly. The tubular body may include any number of apertures 30 and the apertures may be positioned along any portion of the length of the tubular member. In some embodiments, the tubular body includes a plurality of apertures (e.g., weep holes) positioned proximate fletching of the arrow.

FIG. 1B illustrates the device 12 (e.g., self-contained scent delivery system), which is shown as generally comprising a nock 14 comprising a body 16, a notch 18, a scented member 20, and a cap 22. The body 18 may be constructed from any one or combination of materials such as a plastic, a polymer, a metal, a metallic alloy, a natural material such as wood, or other suitable material that would be known to one of ordinary skill in the art with the present disclosure before them.

The body 16 is generally fabricated to have a circular cross sectional area along at least a portion thereof and may transition to a flatter cross section towards the notch 18. In some instances, cross section of the body may be slightly tapered or otherwise shaped to ensure that the nock 14 may be inserted within the second end of the elongated tubular body of the arrow. The shape of the nock 14 may facilitate secure but releasable engagement of the nock 14 with the arrow. That is, the nock 14 may be shaped to compressively engage with the sidewall of the second end of the arrow.

The scented member 20 is shown as being threadably engaged with the body 16. The scented member 20 may include any one or a number of devices capable of receiving and/or retaining a scent, such as animal estrus, acorn cover, animal urine, and musk, for example. The scented member 20 may comprise a wick, a rope, a cloth, an absorbent material, and so forth. The scented member 20 may comprise a fluid scent, either in gaseous or liquid form. In other embodiments, the scented member 20 may comprise a strip of material that has been impregnated with a scent. The scented member 20 may include any device that may be selectively joined to the base and provide a scent.

In some embodiments, the cap 22 may be installed to cover the scented member 20 and engage with the body 16 of the nock 14. It is noteworthy that the outside diameter of the cap 22 may be slightly smaller than the inside diameter of the arrow. Moreover, when the cap 22 covers the scented member 20, the scent provided by the scented member 20 may be at least partially trapped within the cap 22 preventing user exposure to the scent and/or direct contact with the scented member 20.

Additionally, the body 16 may be inserted within the open end of the cap 22 such that the cap 22 is releaseably secured to the end of the body 16. Advantageously, the compressive force between the cap 22 by the body 16 may be of sufficient magnitude to secure the cap 22 to the body 16, but also allow for the cap 22 to disengage from the body 16 when needed, as will be described in greater detail infra.

In accordance with the present technology, the compressive force that joins the cap 22 to the body 16 may be of sufficient magnitude to allow the cap 22 to disassociate from the body 16 when the arrow is shot from a bow and impacts an object, such as the ground or a tree.

In some embodiments, the device 12 may be provided with a fluid scent disposed within the cap 22. The cap 22 may then be joined to the body 16 with or without the scented member 20.

In other embodiments, the device 12 may comprise a body 16 that is not associated with a nock. That is, the body 16 may be any object that is associated with a scented member 20, such as a plug, stopper, ring, cylinder, and so forth. Moreover, the body 16 may also be releaseably associable with a cap 22, as described above. Because the body 16 may not be associated with the nock, the device 12 may be disposed anywhere within the body of the arrow. Preferably, the device 12 may located within the arrow to allow the cap 22 to be disassociated from the body 16 when the arrow is fired and impacts an object. The disassociation of the cap 22 and the body 16 exposes the scent and/or the scented member 20.

Thus, in some instances, the arrow may comprise a two-part arrow whose parts are selectively separable to allow for the device 12 to be inserted within the arrow. In other instances, the device 12 may be inserted within the arrow through the tip end (e.g., the opposing end to the nock). Additionally, while the arrow has been described as comprising apertures/weep holes that are disposed proximate the nock or fletching, it will be understood that the apertures may be located along any length of the arrow.

In some additional embodiments, the device 12 may be configured to attach to an attachment member 16A the outside of the arrow, such as with a clip, a bracket, an adhesive, and so forth. Again, the device 12 may be positioned along the arrow to allow the cap 22 to be disassociated from the body 16 upon the arrow impacting an object.

In some instances, the device 12 may be sized such that the device 12, when inserted within the arrow, freely slides within the body of the arrow. Moreover, the cap 22 may be permanently or fixedly attached to the body 16. Additionally, the cap 22 may be fabricated from a brittle material such as a thin glass. When the arrow is released and impacts an object, the impact forces cause the device 12 to travel downwardly within the arrow towards the tip of the arrow. The cap 22 may shatter upon impacting the tip of the arrow, releasing scent contained within the cap 22.

Contrastingly, in some embodiments, the cap 22 may comprise a bumper 24 that is associated with the terminal end of the cap 22. The bumper 24 may be utilized to prevent the cap 22 from being damaged as the cap 22 travels downwardly through the arrow towards the field point. In some instances, contact with the field point may crack, deform, or otherwise damage the cap 22. According to other embodiments, rather than the bumper 24 being associated with the cap 22, the bumper 24 may be disposed and located within the arrow at any position between to the location of the device 12 and the field point. When the cap 22 disassociates from the body 16, the cap 22 may slide within the arrow and impact the bumper 24 rather than the end of the arrow (e.g., leading tip).

In operation, the device 12 may be inserted into the second end of the arrow such that the cap 22 is inserted within the open cavity of the arrow. The body 16 of the device 12 is urged into the second end to compressively engage the body with the second end and secure the device 12 to the arrow. When the arrow is launched with a bow and impacts an intended target, such as the ground, the impact force causes the body 16 of the nock 14 to remain securely engaged with the second end of the arrow while the cap 22 is disassociated from the body 16. Disassociation of the cap 22 from the body 16 causes the scented member 20 to become exposed and allows scent to be transmitted from within the arrow, outwardly to the ambient environment.

To refill the arrow for another use, the device 12 is removed by removing the nock 14 from the second end of the arrow. When the arrow is tilted, the cap 22 may slide out from within the arrow. An entirely new device 12 may be reinserted into the arrow. Alternatively, a scent may be reapplied to scented member 20 and the cap re-engaged with the body 16 to seal the scented member 20.

Figures 2A, 2B:
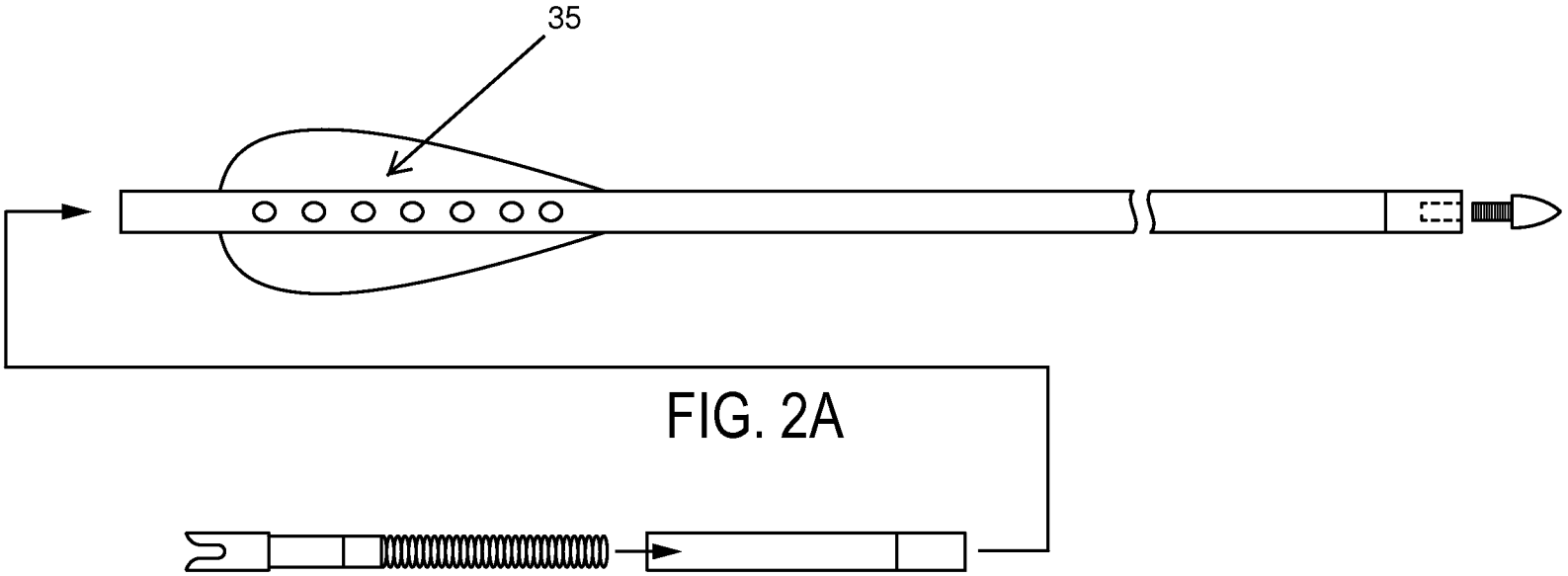
FIG. 2A is an exploded, perspective view of another arrow, for use in accordance with the present technology.
FIG. 2B is an exploded, perspective view of another scent delivery device, for use in accordance with the present technology.

FIGS. 2A and 2B collectively illustrate another scent delivery system (FIG. 2A) and another exemplary scented device (FIG. 2B). The delivery system of FIG. 2A is constructed substantially similarly to the system of FIG. 1A with the exception that the delivery system of FIG. 2A has a different aperture pattern 35 from the delivery system of FIG. 1A.

The scented device of FIG. 2B is constructed in a substantially similar manner to the scented device of FIG. 1B with the exception that the scented member is shown as being integrally or singularly formed with the body of the nock.

The above description is illustrative and not restrictive. Many variations of the technology will become apparent to those of skill in the art upon review of this disclosure. The scope of the technology should, therefore, be determined not with reference to the above description, but instead should be determined with reference to the appended claims along with their full scope of equivalents.

In the foregoing specification, the invention is described with reference to specific embodiments thereof, but those skilled in the art will recognize that the invention is not limited thereto. Various features and aspects of the above-described invention can be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A scent delivery device configured to be housed within an arrow, the arrow having at least one opening to allow scent within the arrow to pass outwardly from the arrow, the device comprising:

a base member at least partially insertable within a body of the arrow;

a scent bearing member associated with the base;

a cap releaseably associable with the base, the cap covering the scent bearing member; and wherein when the arrow is traveling at a sufficient velocity and impacts an object, the cap of the scent delivery device disassociates from the base and uncovers the scent bearing member allowing scent of the scent bearing member to pass outwardly from the arrow through the at least one opening.

2. The device according to claim 1, wherein the base comprises a nock.

3. The device according to claim 1, wherein the cap comprises a bumper disposed on a terminal end of the cap.

4. The device according to claim 1, wherein the at least one opening comprises a plurality of apertures disposed proximate a fletching of the arrow.

5. The device according to claim 1, wherein the scent bearing member comprises any of animal estrus, acorn cover, animal urine, and musk.

6. A scent delivery device configured to be housed within an arrow, the arrow having at least one opening to allow scent within the arrow to pass outwardly from the arrow, the device comprising:

a body member at least partially insertable within the arrow;

a scent disposed within a cap;

the cap being releaseably associable with the base; and wherein when the arrow is traveling at a sufficient velocity and impacts an object, the cap of the device is breached within the cap, allowing the scent to pass through the at least one opening.

7. The device according to claim 6, wherein the base comprises a nock.

8. The device according to claim 6, wherein the at least one opening comprises a plurality of apertures disposed proximate a fletching of the arrow.

9. A scent delivery arrow, comprising:

a body having a first section and a second section that are releaseably attachable to one another, the first section having at least one opening providing a path for outward communication of fluid from within the body; and a scent delivery device, comprising:

a base member at least partially insertable within the body of the arrow;

a scent bearing member associated with the base member; and a cap covering the scent bearing member, the cap being releaseably associable with the base in such a way that the cap releases from the body when an impact force is applied to the arrow.

10. The arrow according to claim 9, wherein the cap is at least partially filled with a scented fluid.

11. The arrow according to claim 9, wherein the scented fluid comprises any of animal estrus, acorn cover, animal urine, and musk.

12. The arrow according to claim 9, wherein the base member is configured to compressively engage with an open end of the first section.

13. The arrow according to claim 9, wherein the at least one opening comprises a plurality of apertures disposed proximate a fletching of the arrow.

14. The arrow according to claim 9, wherein the scent bearing member comprises any of animal estrus, acorn cover, animal urine, and musk.

* * * * *